United States Patent [19]

Stahlecker

[11] Patent Number: 4,944,145

[45] Date of Patent: Jul. 31, 1990

[54] SPINNING MACHINE FOR PRODUCING FEEDING PACKAGES FOR TWISTING

[75] Inventor: Fritz Stahlecker, Bad Überkingen, Fed. Rep. of Germany

[73] Assignee: Hans Stahlecker, Fed. Rep. of Germany; a part interest

[21] Appl. No.: 350,404

[22] Filed: May 11, 1989

[30] Foreign Application Priority Data

May 21, 1988 [DE] Fed. Rep. of Germany ..... 3817493

[51] Int. Cl.[5] ..... D01H 1/115; D01H 5/28; D01H 15/00

[52] U.S. Cl. ..... 57/261; 57/81; 57/264; 57/328

[58] Field of Search ..... 57/80, 81, 261, 264, 57/328, 90, 263, 350

[56] References Cited

U.S. PATENT DOCUMENTS 4,484,436 11/1984 Nakayama et al. ..... 57/328
4,790,130 12/1988 Stahlecker et al. ..... 57/261
4,819,419 4/1989 Stahlecker et al. ..... 57/261
4,845,936 7/1989 Artzt et al. ..... 57/261

FOREIGN PATENT DOCUMENTS 3610110 10/1987 Fed. Rep. of Germany .
3611050 10/1987 Fed. Rep. of Germany .

*Primary Examiner*—John Petrakes
*Attorney, Agent, or Firm*—Evenson, Wands, Edwards, Lenahan McKeown

[57] ABSTRACT

In a spinning machine having a plurality of spinning units for producing packages used as feeding packages for twisting which have two prestrengthend yarn components, a combined quality value of two yarn components is monitored and, in the case of a quality defect, the spinning operation is interrupted, the time of the interruption of the spinning operation being coordinated with the time of the stopping of the partially wound spool in such a manner that a yarn end, which is connected with the stopped partially wound spool, is located at a given position.

10 Claims, 4 Drawing Sheets

SPINNING MACHINE FOR PRODUCING FEEDING PACKAGES FOR TWISTING

BACKGROUND AND SUMMARY OF THE INVENTION

The invention relates to a spinning machine having a plurality of spinning units for producing packages used as feeding packages for twisting. Each spinning unit has two drafting units, two false-twisting devices, a withdrawal device for two prestrengthened yarn components, which are guided together as a double yarn, and a device for winding the double yarn onto a yarn package. Devices are also provided for monitoring the quality with respect to a quality value combined from both yarn components, for interrupting the spinning operation when a quality defect is detected, and for holding ready a yarn end connected with a stopped partially wound spool package in a given position.

A spinning machine is known having a plurality of spinning units from German Examined Published patent application, (DE-A) 36 10 110, in which the prestrengthened yarn components, which were guided together to form a double yarn, pass through a quality monitor in order to be able to carry out a cleaning operation for the removal of unacceptably thick or thin points before the yarn components are wound onto the yarn package. As a criterion for the necessity of a cleaning, an overall yarn value is determined from both yarn components. If a quality defect is detected, both yarn components are separated, and the spinning operation is interrupted. In this construction, the end of the separated yarns moves onto the partially wound spool package.

It is also known from German Published Examined patent application (DE-A) 36 11 050, to lift the partially wound spool off its drive and to interrupt the spinning operation with a time delay when a quality defect is detected. The yarn or double yarn, which is continuously furnished while the partially wound spool package is being stopped, is sucked into a suction pipe. In the case of this construction, the yarn end, which is connected with the partially wound spool package, is available at a certain point for the piecing operation, at which it is held by means of a yarn clamp.

An object of the invention is to develop a spinning machine of the initially mentioned tYpe such that it is ensured, in a simple but nevertheless reliable manner, that the yarn is held ready at a defined point for a piecing operation, so that particularly no awkward searching is required for the yarn end or even two yarn ends on the partially wound spool package.

This object is achieved according to preferred embodiments of the invention in that, a program control unit is provided for the coordination of the time of the interruption of the spinning operation and the time of the stopping of the partially wound spool package.

It is therefore ensured that, on the one hand, no excessive quantity of fiber material is wasted, while, on the other hand, the yarn is not stressed by an untimelY clamping-fast or the like, in such a manner that it also breaks.

Other objects, advantages and novel features of the present invention will become apparent from the following detailed description of the invention when considered in conjunction with the accompanying drawings.

DETAILED DESCRIPTION OF THE DRAWING

Figure 1:
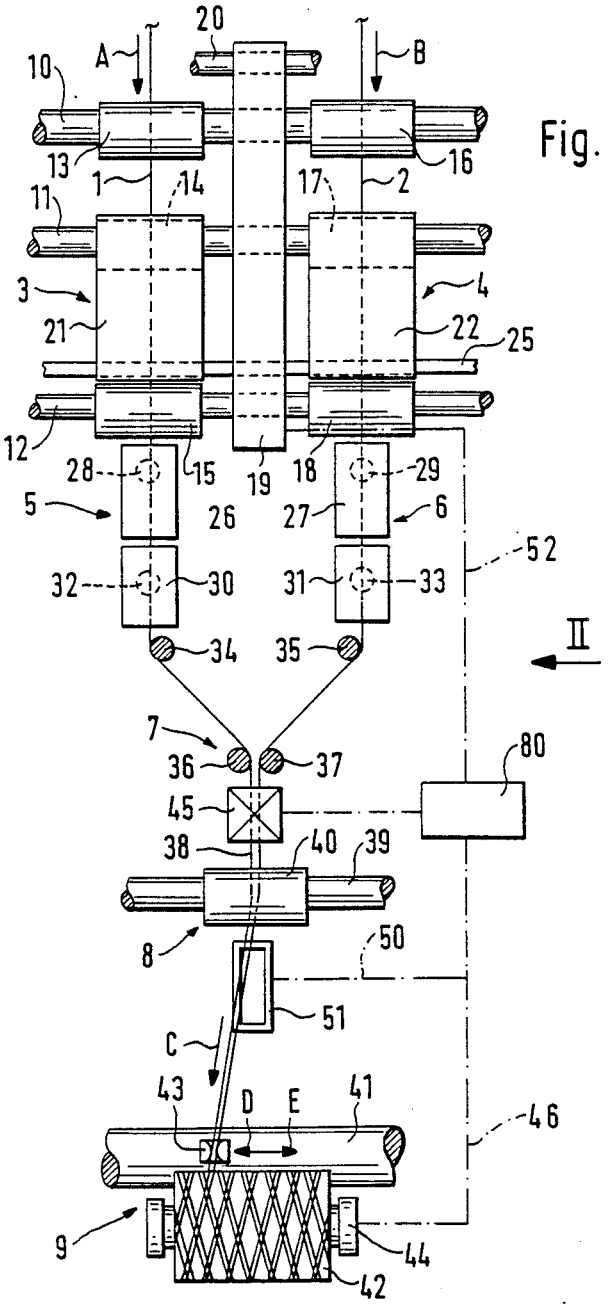
FIG. 1 is a schematic view from the operator's side of an individual spinning unit constructed according to a preferred embodiment of the invention.
Figure 2:
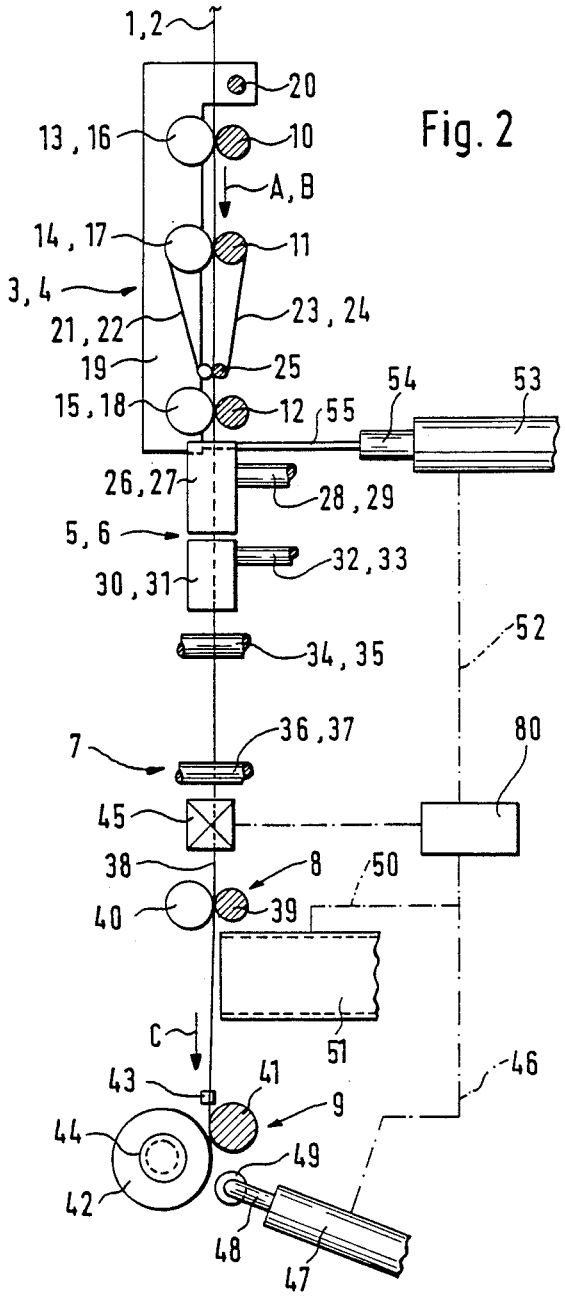
FIG. 2 is a lateral view in the direction of arrow II of the spinning unit of FIG. 1.

In the drawings, only one spinning unit of a spinning machine is shown, it being understood that a plurality of such spinning units are arranged in a row next to one another on one side of the spinning machine.

Two yarn components 1, 2 enter in the direction of the arrows (A and B) into drawing or drafting units 3, 4 of the spinning unit and are directed to travel in parallel to one another and be drafted to the desired yarn size. A false-twisting element 5, 6 is assigned to each yarn component 1, 2 and follows directly behind the drafting units 3, 4. In the false-twisting element 5, 6, the yarn components 1, 2 are slightly prestrengthened, in that a number of fiber ends are wound around the yarn core and, even after the false twist is opened up, remain wound around this core.

The yarn components 1, 2 leaving the false-twisting elements 5, 6 are guided by yarn guides 34, 35 and 36, 37 in such a manner that they are guided together to form a double yarn 38, in which they maintain a slight mutual distance. This double. yarn 38 is withdrawn by means of a withdrawal device 8 and is guided in the direction of the arrow (C) to a wind-up device 9, which winds the double yarn 38 side-by-side onto a cross-wound package 42. This cross-wound package 42 will then be used as a feeding package for a subsequent twisting operation, for example, on a ring twisting frame or on a double-twist frame.

The drafting units 3, 4 are shown as three-cylinder apron drafting units. Naturally, other drafting units may also be used. The shown drafting units 3, 4 contain common bottom cylinders 10, 11, 12, which extend through in the longitudinal direction of the machine and which, are driven in a headstock at the machine end. Spring-loaded pressure rollers 13, 14, 15; 16, 17, 18 are assigned to each drafting unit 3, 4. These pressure rollers are combined as so-called pressure roller twins and are held in a load carrier 19. In addition, the drafting units 3, 4 contain top aprons 21, 22 and bottom aprons 23, 24, which are guided around a deflecting rail 25 passing through in the longitudinal direction of the machine. The load carrier or weighting arm 19 is pivotable around a shaft 20 extending in parallel with respect to the bottom cylinders 10, 11, 12. By means of the swivelling-away of this load carrier 19 around its swivel shaft 20, the drafting units 3, 4 are opened up, so that the further intake of yarn components 1, 2 is interrupted.

The false-twisting devices 5, 6 each comprise of two air nozzles 26, 30; 27, 31 arranged behind one another, which are provided with compressed-air connections 28, 32; 29, 33. The respective first air nozzles 26, 27, which are arranged directly at the outlet of the drafting units 3, 4, are constructed as so-called intake nozzles, while the air nozzles 30, 31 are the actual false-twisting nozzles.

The yarn guiding elements, which are connected behind the false-twisting devices 5, 6, contain yarn guiding pins 34, 35, 36, 37 which guide the two yarn components 1, 2 together so that they extend closely adjacent to one another.

The withdrawal device 8, which follows, contains a bottom cylinder 39, which extends through in the longitudinal direction of the machine and is driven at the machine end in the headstock, one pressure roller 40 respectively being assigned to this bottom cylinder 39 at each spinning unit.

The wind-up device 9 contains a winding roller 41, which extends through in the longitudinal direction of the machine and is driven at the machine end in the headstock, the spool package 42, in the normal operation, being disposed on this winding roller 41 and this winding roller 41 driving the spool package 42. The spool package 42 is held by an outlined spool package holder 44. The wind-up device 9 also includes a cross-winding device 43, which is only outlined and which can be moved back and forth in the direction of the arrows (D and E). In addition, the wind-up device 9, in a manner which is not shown in detail, contains a compensating device by means of which the changes in length and tension are compensated during the cross-winding movement.

In the shown embodiment, a quality monitor 45 is arranged in front of the withdrawal device 8 and behind the yarn guiding pin 36, 37 in the area of the double yarn 38 This quality monitor 45 simultaneously monitors the two yarn components 1, 2 and thus determines a quality value which is formed from the combination of the two yarn components 1, 2. In a corresponding manner, as a modification of the shown embodiment, a quality monitor 45 may also be arranged behind the withdrawal device 8. It is also contemplated according to certain embodiments to assign a separate quality monitor to each yarn component, in which case a linking of the measured values will then take place by means of a corresponding evaluating circuit. The quality monitor 45 monitors the two yarn components 1, 2, with respect to thick points and thin points, as to whether they maY lead to no longer acceptable irregularities in the later produced twisted yarn. If such a quality deviation is determined, the quality monitor 45 emits a corresponding signal.

The spinning unit is also equipped with devices for the opening and closing of the drafting units 3, 4, i.e., for the swivelling of the weighting arm 19 around its shaft 20. For this purpose, a pneumatic press 53 is used, the piston 54 of which is applied via a connecting rod to the end of the weighting arm 19 which faces away from the shaft 20. Between the withdrawal device 8 and the wind-up device 9, a yarn storage device 51 is also arranged, which can be activated, if necessary. A lift-off mechanism is also assigned to the spool package 42 and comprised a pneumatic press 47, the piston 48 of which is equipped with a lift-off roller 49, which can be applied to the spool package 42.

Figure 3:
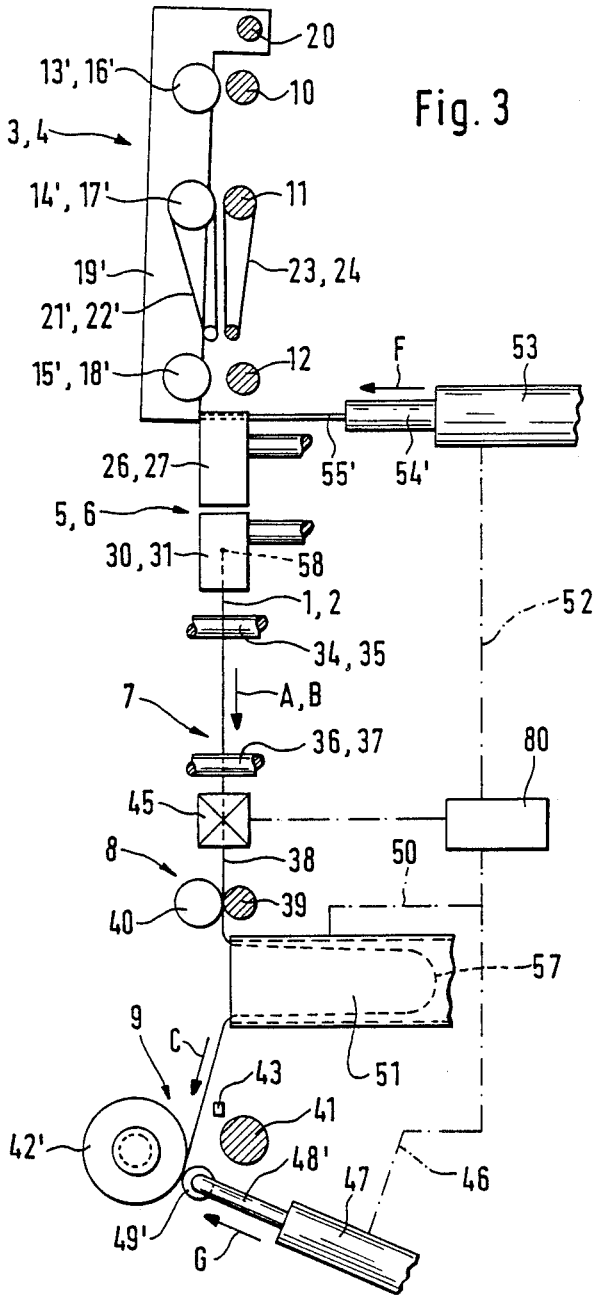
FIG. 3 is a view corresponding to FIG. 2, depicting the spinning unit when a quality defect is discovered and the spinning operation is already interrupted.
Figure 4:
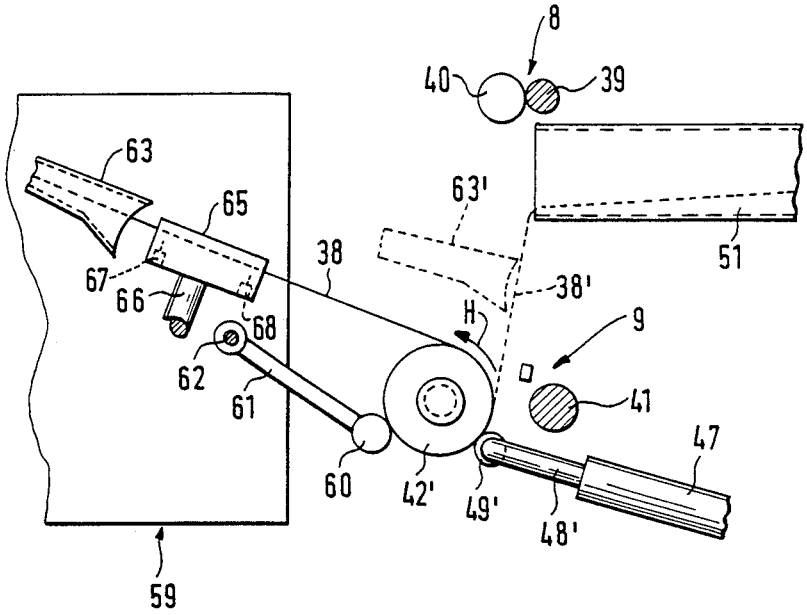
FIG. 4 is a schematic view depicting details of a spinning unit and of a servicing device applied to this spinning unit for a piecing operation, constructed in accordance with preferred embodiments o the invention.

FIGS. 3 shows a case where the quality monitor 45 has detected a no longer tolerable quality defect and has emitted a corresponding signal to the program control unit 80. Corresponding to FIG. 3, some of the elements are transferred to an inoperative position, which is characterized in that the corresponding reference numbers are each provided with a "'." (Primed). The control unit 80 first causes the start of the operation of the pneumatic press 47, which is connected with it by means of a control line 46 and which moves out the piston 48' with the lift-off roller 49' in the direction of the arrow (G) and lifts the partially wound spool package 42' off the winding roller 41. As a result of its mass moment of inertia, the partially wound spool package 42' continues to rotate, although it is separated from its drive. At this time, the storage device 51 is activated, which is connected with the control unit 80 by means of a control line 50, so that the excess double yarn, which was furnished as a result of the slowing-down of the no longer driven partially wound spool package 42', while the speed of the withdrawal device 8 remained the same, is sucked into the yarn storage device 51 as a yarn loop 57. Shortly before the partially wound spool package 42' is stopped, or at the latest, after it has stopped, the pneumatic press 53 is activated by the control unit 80 via the control line 52, so that the piston 54' moves out in the direction of the arrow (F) and, by means of the actuating rod 55', swivels the weighting arm 19' around the shaft 20. At this moment, any further supply of sliver is interrupted so that the yarn components 1, 2 are interrupted. In FIG. 3, it is shown that the ends 58 are already located in the area of the air nozzles 30, 31. Since the withdrawal device 8 continues to run at an unreduced speed, the remaining double yarn 38 is withdrawn and sucked into the yarn storage device 51. The spinning unit will then be in a condition, in which it is ready for the piecing operation and in which the double yarn, which is connected with the partially wound spool 42', is available between the storage device 51 and the partially wound spool 42'. It should be pointed out that the same operation also takes place in the case of a yarn breakage, since the breakage of one of the yarn components 1, 2 is naturally an unacceptable quality defect.

The subsequent piecing is carried out by means of a movable servicing device 59, which can be applied to the corresponding spinning unit. The servicing device 59 contains a suction nozzle 63, which can be applied to the double yarn 38 between the lifted-off, partially wound spool package 42' and the yarn storage device 51. The suction nozzle, which was brought to position 63', sucks up the double yarn 38' and then moves back into the servicing device 59. The servicing device 59 is also equipped with an auxiliary winding roller 60, which is arranged on a lever arm 61, which can be swivelled around a shaft 62 in such a manner that the auxiliary winding roller 60 can be applied to the lifted-off partially wound spool package 42'. The auxiliary winding roller 61 is equipped with a drive, by means of which it can be driven into both rotating direction. The auxiliary winding roller 60 drives the lifted-off partially wound spool package 42' first in the withdrawal direction (arrow H), so that the double yarn 38 is sucked into the suction nozzle 63. In this case, such a length is sucked off that the point of the double yarn 38 having the quality defect is wound off the partially wound spool package 42' and is entered into the suction nozzle 63. The double yarn 38 is placed in a splicing arrangement 65 of the servicing device 59, which is equipped with a compressed-air supply line 66 and clamping and cutting devices 67, 68. During the piecing, a new double yarn will then be produced at the corresponding spinning units which, in the opposite direction, is also placed in the splicing device 65 and which is connected with the double yarn 38 wound off the partially wound spool package 42'. Commonly assigned U.S. patent application Ser. No. 350,520, filed May 11, 1989, based on German patent application P3817222.4, filed May 20, 1988 in Germany, discloses further features of yarn storage and yarn splicing devices that could be used with the present invention.

During the interruption of the spinning operation by means of the opening of the drafting units 3, 4 as a function of the stopping of the lifted-off partially wound spool package 42', the control unit 80, for example, may take over a corresponding control. For example, the opening of the drafting units 3, 4 may be set to take place with a certain time delay, which may be such that it corresponds to the time, which an almost full package 42 requires in order to slow down from the operating speed, after being lifted off the winding roller 41, and come to a standstill. In a modified embodiment, it is provided that a rotational speed emitter is assigned to the lift-off roller 49, by means of which the condition of the lifted-off package 42' may be determined; i.e., it may be determined whether the package 42' is still rotating or is standing still or whether the standstill is imminent.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A spinning machine arrangement for producing yarn packages used as feeding packages for subsequent twisting operations, comprising:

drafting means for drafting two yarn components, false twisting means for false twisting the two yarn components, windup means for winding up the two yarn components as a double yarn on a spool package, yarn quality monitoring means for monitoring the quality of the yarn components.

spinning operation interrupting means for interrupting the spinning operation in response to detection of a yarn quality defect by the yarn quality monitoring means.

windup operation interrupting means for interrupting the operation of the windup means to cause stoppage of a partially wound package in response to the detection of a yarn quality defect by the yarn quality monitoring means, and a program control unit means including means for automatically controlling the spinning operation interrupting means and the windup operation interrupting means with coordination of the timing of the spinning interruption and the windup interruption and stoppage of the partially wound spool package to facilitate minimal waste of fiber material and assure location of the yarn end at a defined point for subsequent piecing.

2. An arrangement according to claim 1, further comprising yarn end holding means for holding a yarn end connected with a stopped partially wound spool package in a predetermined ready position for subsequent piecing with newly spun yarn supplied from the false twisting means.

3. An arrangement according to claim 2, comprising yarn storage device means connected behind the windup means, wherein the yarn program control unit means includes means for controlling operation of the yarn storage device means to effect storage of yarn during stoppage of a partially wound spool package by the windup operation interrupting means.

4. An arrangement according to claim 2, comprising yarn guiding means disposed between the false twisting means and the yarn quality monitoring means for guiding the two yarn components to travel together as a double yarn through the yarn quality monitoring means.

5. An arrangement according to claim 1, comprising yarn storage device means connected behind the windup means, wherein the yarn program control unit means includes means for controlling operation of the yarn storage device means to effect storage of yarn during stoppage of a partially wound spool package by the windup operation interrupting means,

6. An arrangement according to claim 5, wherein said yarn storage device means includes suction means.

7. An arrangement according to claim 5, comprising yarn guiding means disposed between the false twisting means and the yarn quality monitoring means for guiding the two yarn components to travel together as a double yarn through the yarn quality monitoring means.

8. An arrangement according to claim 1, comprising yarn guiding means disposed between the false twisting means and the yarn quality monitoring means for guiding the two yarn components to travel together as a double yarn through the yarn quality monitoring means.

9. An arrangement according to claim 1, comprising a plurality of similar commonly driven spinning units with said drafting means, false twisting means, windup means, and yarn quality monitoring means.

10. An arrangement according to claim 9, comprising a mobile servicing means which is selectively movable to respective spinning units to perform a piecing operation connecting yarn ends from the partially wound spool package with newly spun yarn ends.

* * * * *